US005096678A

United States Patent [19]

Mackie

[11] Patent Number: 5,096,678

[45] Date of Patent: Mar. 17, 1992

[54] METHOD AND APPARATUS FOR BENEFICIATING ORES

[76] Inventor: Daniel A. Mackie, 474 Copeland Court, Oakville, Ontario, Canada, L6J 4B9

[21] Appl. No.: 624,955

[22] Filed: Dec. 10, 1990

Related U.S. Application Data

[62] Division of Ser. No. 273,536, Nov. 21, 1988, Pat. No. 4,991,824.

[30] Foreign Application Priority Data

Nov. 19, 1987 [GB] United Kingdom ..... 8727124

[51] Int. Cl.[5] ..... C01G 7/00

[52] U.S. Cl. ..... 423/27; 423/28; 423/29; 423/31; 423/109; 423/98; 423/131; 423/205; 75/733; 75/736

[58] Field of Search ..... 209/457, 455; 423/27, 423/28, 29, 31, 131, 150, 205, 98, 109; 75/733, 736

[56] References Cited

U.S. PATENT DOCUMENTS

| | | | |
|---|---|---|---|
| 331,071 | 11/1885 | Loder | 209/457 |
| 2,006,875 | 6/1935 | Ruth | 423/31 |
| 2,963,155 | 12/1960 | Peterson et al. | 209/457 |
| 4,070,275 | 1/1978 | Stoev et al. | 209/457 |
| 4,190,436 | 2/1980 | Hughes | 423/31 |

OTHER PUBLICATIONS

Society of Mining Engineers of the American Institute of Mining and Metallurgical and Petroleum Engineers, Inc., 1985, vol. 1, Chap. 4, Section 4, pp. 4–27 through 4–32 entitled Hindered Settling Concentration and Jigging by D. E. Picket et al.

*Primary Examiner*—Theodore Morris
*Assistant Examiner*—Edward Squillante
*Attorney, Agent, or Firm*—Arne I. Fors

[57] ABSTRACT

A method and apparatus for treating mineral-bearing ores and, more particularly, for treating ores containing precious metals, base metals and the like values by providing a means to extract the metal or other values from a particulated ore by classifying the ore to separate values from the gangue, and by continuously chemically leaching the said values from the ore. In accordance with an embodiment of the invention, particulated ore is fluidized and intermittently moved through a tank to classify the ore particles into strata according to size, shape and density to beneficiate values, either heavier or lighter than the gangue, for recovery of concentrated values. In accordance with another embodiment of the present invention, crushed or ground ore is moved through a vat leaching jig in such a manner as to cause the heavier metal-laden or other values-laden particles or larger particles to differentially settle to the bottom of the apparatus, which can then be extracted separately and wholly from the finer values such as gold or precious metal particles which may be chemically leached from the ore and recovered from the lixiviant.

3 Claims, 3 Drawing Sheets

METHOD AND APPARATUS FOR BENEFICIATING ORES

This is a division of application Ser. No. 273,536, now U.S. Pat. No. 4,991,824, filed Nov. 21, 1988.

BACKGROUND OF THE INVENTION

This invention relates to a method and apparatus for the beneficiating of ores and is particularly directed to a method and apparatus for classifying ores by size, shape and density while concurrently leaching values from said ores.

Current practice in leaching of gold and other precious metals from an ore involves crushing and grinding the ore to reduce its largest particle size to the point where intimate mixing of a leaching solution, such as sodium cyanide in water, with the particles will cause the gold or precious metal in the particles to dissolve into the solution from which the gold or precious metals are extracted at a later stage in a process plant.

In gold mills currently in use ore which has been diluted in water during the conventional grinding and classification process in grinding mills is thickened in a rake thickener or other device to about 50% solids by weight and then pumped as a slurry to a series of tanks where leaching agents are added. By keeping the slurry agitated with paddle mixers or other mechanical, pneumatic or hydraulic means, intimate mixing of the particles and leaching in solution takes place. Usually a series of tanks are used, one overflowing to the next, such that a leaching time of 12 to 72 hours takes place.

Recently, the high cost of processing low-grade gold and precious metals ores has led to cheaper methods of leaching such as "heap leaching" and "vat leaching".

Heaping leaching involves crushing, but rarely grinding, of an ore and laying the ore by mechanical means as a layer onto a pad on the ground or other prepared surface. A leaching agent is sprayed onto the layer of ore, after which it percolates through the pile, dissolving some of the gold or precious metals. The solution is then collected by drainage underneath and around the pile to a sump, where the solution may be recirculated to the top of the ore pile as often as is necessary to leach out the gold or precious metals, or pumped to a plant to have the gold or precious metals extracted from the solution.

Vat leaching is similar to heap leaching, except that the ore is sometimes ground and placed in a pit or like tank instead of a pile such that the ore is immersed for a more effective soaking to improve contact of the leaching solution with the ore.

Heap leaching or vat leaching is not nearly as efficient as conventional leaching in agitated tanks because the larger particle sizes and lack of mixing does not allow an intimate contact to be made between the leaching agent and the gold or precious metals. Leaching times are typically 10 to 15 days for vat leaching and weeks or months for heap leaching. In addition, both methods are batch processes, requiring adding and removing the ore from the leach area by mechanical means.

It is known to beneficiate ores by classifying solids in slurries using beds fluidized by a countercurrent flow of a liquid or gas medium. Known method, such as for separating bitumen from oil sands, use a continuous flow of rising fluid, usually water, countercurrent to descending solids and effect a separation according to size, shape and density. The product recovered usually is substantially diluted by the volume of separating medium required and must be thickened.

SUMMARY OF THE INVENTION

This invention relates to a method and apparatus for treating mineral-bearing ores and, more particularly, for treating ores containing precious metals, base metals and the like values by providing a means to extract the metal or other values from a particulated ore by classifying the ore to separate values from the gangue, and by continuously chemically leaching the said values from the ore. In accordance with an embodiment of the invention, particulated ore is fluidized and intermittently moved through a tank to classify the ore particles into strata according to size, shape and density to beneficiate values, either heavier or lighter than the gangue, for recovery of concentrated values. In accordance with another embodiment of the present invention, crushed or ground ore is moved through a vat leaching jig in such a manner as to cause the heavier metal-laden or other values-laden particles or larger particles to differentially settle to the bottom of the apparatus, which can then be extracted separately and wholly from the finer values such as gold or precious metal particles which may be chemically leached from the ore and recovered from the lixiviant.

In its broad aspect, the method of the invention for beneficiating particulate ores containing values comprises feeding the particulate ore containing values to a liquid in a tank at the feed end of the tank having a feed end and a discharge end, intermittently fluidizing the ore particles whereby a pulsing or jigging action is created to move said ore particles up and down for classifying said particles into strata according to size, shape and density, and for moving the classified particles from the feed end to the discharge end of the tank, and separately withdrawing classified particles from said tank for recovery of the values therefrom.

More particularly, the method of the invention for beneficiating particulate ores containing values comprises forming a tank having a feed end and discharge end with a bottom surface sloping downwardly from the feed end to the discharge end, adding a leach solution to said tank, feeding the particulate ore containing values soluble in said leach solution to said tank at the feed end thereof, applying an intermittent hydraulic pressure to the leach solution to fluidize the ore particles whereby a jigging action is created to move said ore particles up and down for classifying said particles into strata according to size, shape and density, and for moving the classified particles from the feed end to the discharge end of the tank, whereby said particles are stratified concurrently while values are dissolved by the leach solution, withdrawing classified particles from said tank, and withdrawing the leach solution for recovery of the values therefrom.

The apparatus of the invention for treating a particulate ore for the recovery of contained values therefrom comprises, in its broad aspect, the combination of a tank containing a liquid, said tank having a feed end and a discharge end, means for feeding said particulate ore to the tank at the feed end thereof, means for intermittently fluidizing the particulate ore in the tank with the liquid for classifying the ore particles into strata according to size, shape and density, and for moving the classified particles from the feed end to the discharge end of the tank, means for withdrawing the classified ore particles, and means for withdrawing the liquid therefrom.

The bottom surface of the tank preferably slopes downwardly from the feed end to the discharge end of the tank.

The liquid preferably is a leach solution for concurrently leaching values from the ore while the ore moves from the feed end to the discharge end of the tank, whereby leached values are withdrawn from the tank with the leach solution.

The means for feeding said particulate ore to the tank at the feed end thereof preferably comprises a plurality of equispaced spigots for feeding said particulate ore as a slurry. The bottom of the tank may be horizontal or downwardly sloped from the feed end to the discharge end of the tank at an angle sufficient to promote migration of the particles towards th discharge end of the tank during intermittent fluidization of the ore, i.e. the bottom of the tank may have a slope within the range of 0.3 to 1 inch per foot of length of the tank.

The bottom of the tank is filled with a layer of crushed stone and preferably is covered with a coarse wire mesh. The means for intermittently fluidizing the particulate ore in the tank with the liquid comprises a plurality of pipes equispaced along the bottom of the tank having openings formed therein for the discharge of liquid into the tank under pressure adjacent the bottom surface thereof for at least five seconds, preferably 5 to 10 seconds. The means for withdrawing leach solution from the tank may comprise said plurality of bottom pipes, said leach solution being withdrawn from the tank for at least ten seconds, preferably 10 to 20 seconds, during cessation of fluidizing of the ore, or the leach solution may be withdrawn from the bottom of the tank by a separate set of plurality of bottom pipes.

BRIEF DESCRIPTION OF THE DRAWINGS

The method and apparatus of the invention will now be described with reference to the accompanying drawings, in which.

DESCRIPTION OF PREFERRED EMBODIMENTS OF THE INVENTION

Figure 1:
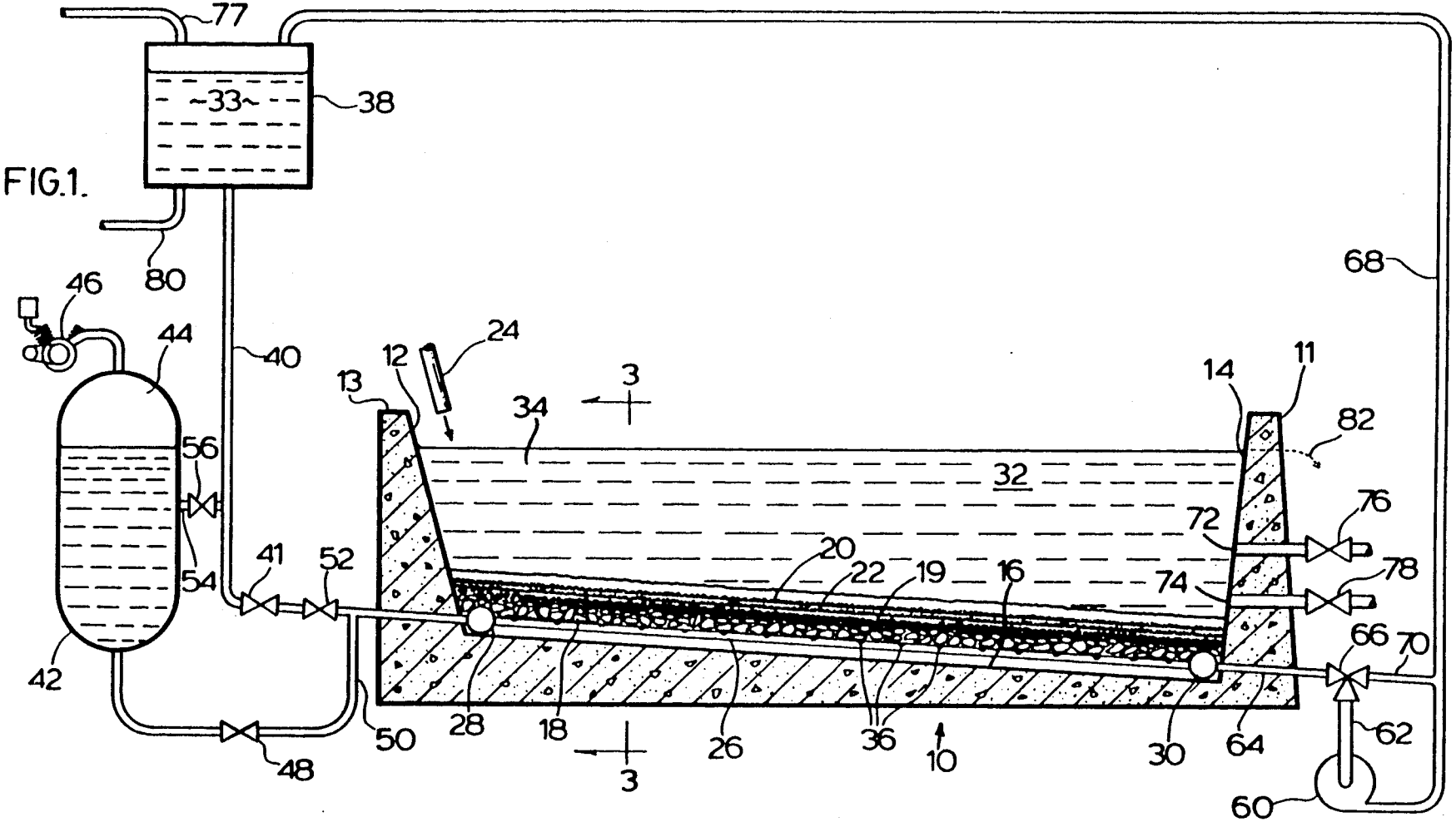
FIG. 1 is a longitudinal section of the apparatus of the invention showing a first embodiment thereof.
Figure 2:
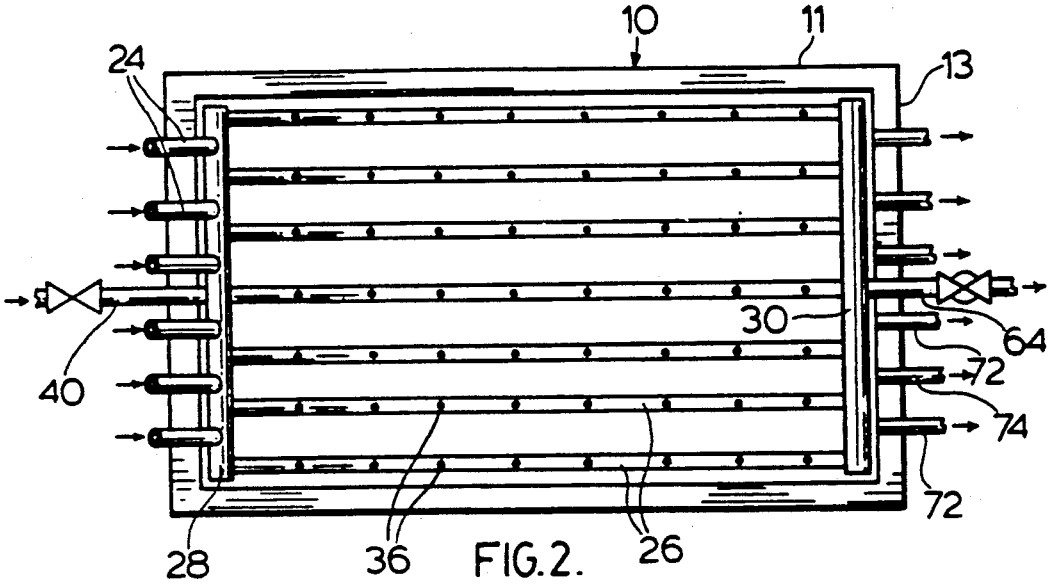
FIG. 2 is a plan view of the embodiment of the invention shown in FIG. 1.
Figure 3:
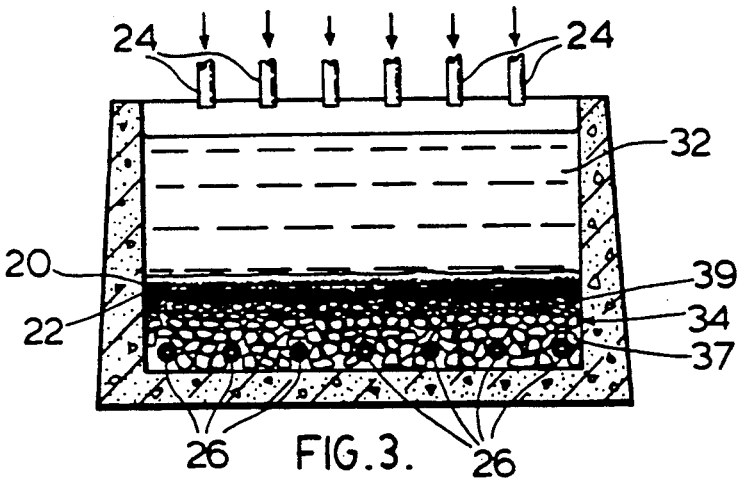
FIG. 3 is a transverse section along the line 3—3 of the apparatus of the invention shown in FIG. 1.

With reference to FIGS. 1, 2 and 3 the apparatus of the invention comprises a tank 10 normally rectangular in plan with side and end walls 11, 13 having a feed end 12 and discharge end 14 with a bottom surface 16 normally sloping downwardly from the feed end 12 to the discharge end 14. Tank 10 may be a lined or unlined pit formed in rock, such as by blasting, or a metal or concrete vessel. The slope of bottom surface 16 should be sufficient to permit and promote migration of particulate solids, as will become evident as the description proceeds, towards discharge end 14. A slope in the range of up to one inch per foot of length of the tank, preferably 0.3 to 1 inch per foot of length of the tank, normally is sufficient for desired migration of the particles, the slope depending on the characteristics of the particulate ore such as size, shape and density of the particles. It will be understood that some ores will require no slope of the bottom surface for effective migration of particles to the discharge end.

The bottom surface of the tank is covered with a coarse particulate material such as crushed stone 18 to form a bed 19 which may be restrained by means of a wire mesh grid 20 which overlays the crushed stone to maintain the desired slope of the bottom surface. This grid may be underlain with a screen 22 which has a mesh finer than the finer particles of the particulate ore to prevent infilling of the crushed stone with the ore particles. The crushed stone preferably is graded from coarse to fine in size, from 1½ inch to ⅜ inch in diameter. If the particulate ore is ⅜ inch or larger in size, screen 22 preferably has ¼ inch mesh openings to separate the ore from the crushed stone bed.

Particulate ore normally is fed as a slurry to tank 10 at feed end !2 uniformly across the width of the tank by a plurality of equispaced spigots 24. Alternatively, particulate ore may be fed by a screw conveyor or by a belt conveyor adapted to uniformly distribute ore particles across the tank.

A plurality of equispaced pipes 26 extend from manifold header 28 at the feed end 12 along the bottom surface 16 of tank 10 to discharge header 30 at discharge end 14. Liquid is introduced to tank 10 through a plurality of spaced perforations such as holes 36 provided along pipes 26 to form pool 32. Pipes 26 are uniformly spaced apart about 6 to 12 inches and holes 36 are spaced along pipes 26 about 6 to 12 inches. Holes 36 may be formed on the top, sides, or bottom of pipes 26 and preferably are formed along the bottom of pipes 26.

Liquid 32 normally is supplied to tank 10 from reservoir tank 38 by means of pipe 40 at a pressure about 20 psi above the static pressure at the height of pipes 26 to provide the desired inflow of liquid to tank 10 for fluidizing particulate ore 34 by the opening of valve 41. An increase in the feed pressure can by provided from reservoir tank 42 having liquid under a substantially higher pressure by means of a compressed air cap 44 maintained by compressor 46. Thus an increase in fluidizing action can be obtained by opening valve 48 in line 50, which is located downstream of check valve 52 in line 40 to prevent a backflow to reservoir tank 38. Tank 42 can be replenished with liquid from reservoir tank 3 through line 54 with valve 56.

Liquid 32 can be a leach solution or lixiviant to dissolve values such as metal values from the particulate ore. For example, the leach solution can be a sodium cyanide solution for dissolving gold from gold ores. It is contemplated that liquid 32 can be water for classifying bitumen in ores such as oil sands wherein the bitumen occurs, or is separated, into discrete flakes which can be classified with inorganic particles such as the sand and silt to form an upper strata on the inorganic particles for separate removal at the discharge end of the tank.

Discharge manifold 30 is connected to the suction of pump 60 by suction line 62 connected to discharge line 64 by three-way valve 66. Discharge line 68 from pump 60 circulates liquid to reservoir tank 38, line 68 having a recycle line 70 for circulating liquid intermittently to pump 60 upon actuation of three-way valve 66, for reasons to be explained during the description of the operation of the method of the invention.

Stratified slurry comprised of particles of ore in the liquid 32 are withdrawn at desired levels by a plurality of spigots 72, 74 controlled by valves 76, 78 respectively. Liquid 32 from tank 10 can be withdrawn from the system by way of outlet 80 from reservoir tank 38 or by permitting liquid 32 to discharge from tank 10 at weir depicted by broken line 82 at the discharge end 14 of the tank. Make-up liquid to reservoir tank 38 is supplied through line 77.

In operation, ore normally is crushed to 100% passing 6 Tyler mesh, or to 100% passing 50 Tyler mesh or smaller, as is appropriate for the ore to be leached, and preferably is fed to tank 10 as a slurry through equispaced spigots 24.

Liquid 33 is supplied to tank 10 from reservoir tank 38 by opening of the valve 41 to permit a flow into tank 10 through openings 36. A uniform upward flow of liquid thus is provided across the bottom and along the length of tank 10 to fluidize the particulate ore above crushed stone base 19, i.e. about 1 to 6 inches above mesh 20, for at least five seconds, normally for a period of time of 5 to 10 seconds. The temporary fluidizing of particulate ore 34 permits classifying and stratification of the ore according to particle size, shape and density, the coarser and heavier particles of rounded shape normally forming a lower layer while the lighter, finer and angular or plate-shaped particles normally forming upper strata. The fluidizing of the ore particles causes attrition of the particles among themselves while washing the particle surfaces with liquid to enhance dissolving of the values in leach solutions.

Valve 40 is then closed to cease fluidizing of the ore particles and three-way valve 66 is opened to suction line 62 of pump 60 for at least ten seconds, preferably 10 to 20 seconds depending on the size distribution of the particulate material, to produce a suction along lines 26 to withdraw liquid 32 from the tank 10 for recycle to reservoir tank 38 by Way of line 68. The particulate ore settles on crushed stone bed 19 which forms an effective filter bed to prevent egress of fine particles with the liquid withdrawn from tank 10. It is desired that the suction pressure along pipes 26 be minimized to avoid cavitation, particularly with sodium cyanide leach solution, to minimize oxidation of leach solutions. Valve 66 closes line 64 at the end of the suction cycle and opens line 70 to allow liquid to circulate at pump 60 during the feed cycle through line 40 on opening of valve 41.

With reference to FIG. 3, the particulate ore 34 is classified into strata in tank 10 with coarse, heavy particles 37 stratified at the bottom and progressively finer and lighter particles 39 stratified to the top. With the repeat of each fluidizing and settling cycle, the ore particles migrate towards the discharge end 14 of tank 10 for discharge through a plurality of spigots typified by numeral 72, 74.

Figure 4:
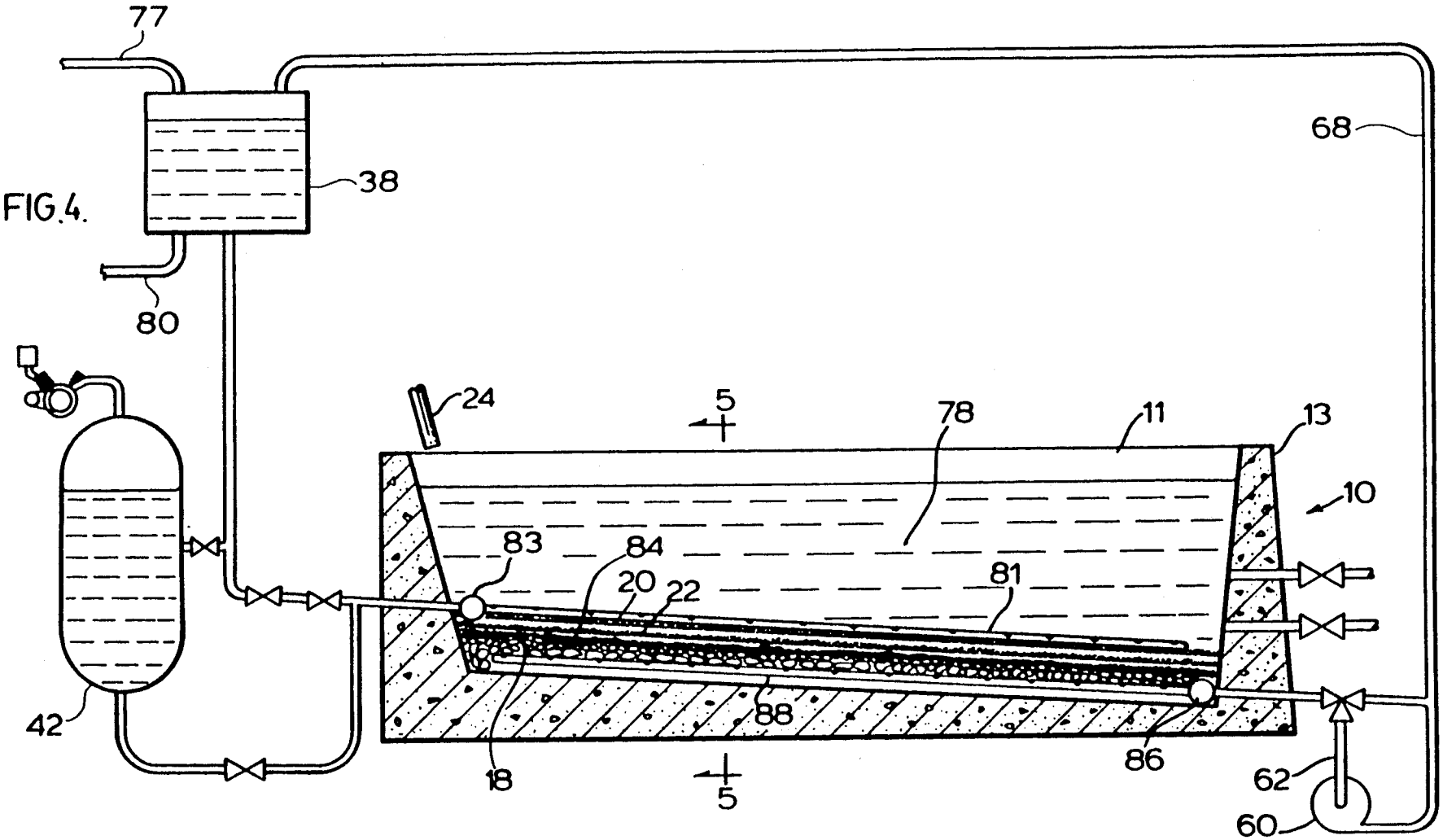
FIG. 4 is longitudinal section of a second embodiment of the apparatus of the invention.
Figure 5:
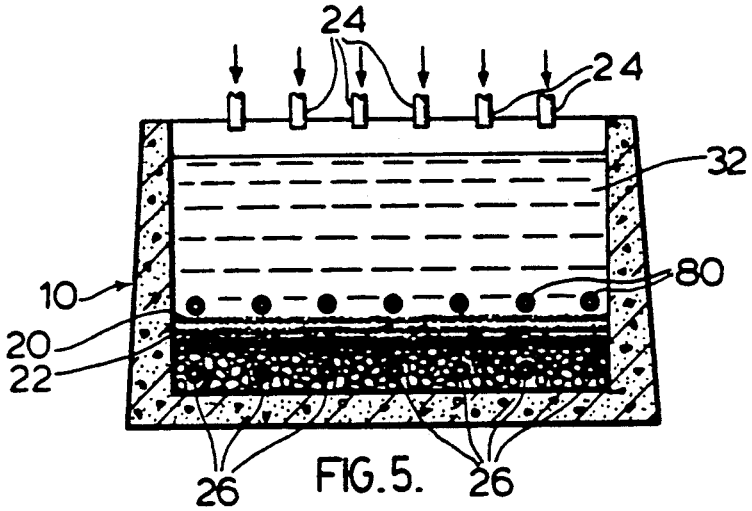
FIG. 5 is a transverse section along lines 5—5 of FIG. 4.

With reference now to the embodiment of my invention shown in FIGS. 4 and 5, liquid is added to the slurry bed 78 to fluidize said bed through equispace perforated feed pipes 81 from feed manifold 83 positioned immediately above crushed stone bed 19 at the bottom of slurry bed 84. Discharge manifold 86 connected to the suction of pump 60 has a plurality of equispaced perforated discharges pipes 88 disposed along the bottom surface 16 of tank 10 at the base of crushed rock bed 19 for withdrawal of liquid from tank 10.

This embodiment of the invention has particular utility in treating ores having a high content of fine particles such as clay or silt, or ores which have been finely ground. The crushed stone bed 84 preferably is of sufficient depth and is constituted of a finer size to more effectively function as a filter bed to prevent ore fines being withdrawn with the discharge liquid through pipes 88.

It will be understood that although the description of the method and apparatus of the invention has proceeded with reference to the leaching of gold from ores by means of sodium cyanide solution, the invention has utility in leaching sulphates and the like ores with acid leachants for recovery of metal values such as copper, nickel and lead. Values such as bitumen in oil sands can be beneficiated by classification and recovered as a slurried solid concentrate.

It will also be understood that modifications can be made in the embodiment of the invention illustrated and described herein without departing from the scope and purview of the invention as defined by the appended claims.

I claim:

1. A method for beneficiating particulate ores containing soluble metal values comprising continuously feeding the particulate ore containing said values to a liquid in a tank at the feed end of the tank having a feed end and a discharge end, intermittently uniformly fluidizing the ore particles with a liquid for five to ten seconds and intermittently withdrawing said liquid for about 10 to 20 seconds across and along the tank whereby a pulsing or jigging action is created to move said ore particles up and down for classifying said particles into strate according to size, shape and density, and for moving the classified particles from the feed end to the discharge end of the tank, continuously separately withdrawing classified particles from said tank for recovery of the values therefrom, and recycling said liquid for intermittently fluidizing the ore particles.

2. A method of leaching particulate ores containing soluble metal values comprising; forming a tank having a feed end and discharge end for containing a leach solution, continuously feeding the particulate ore containing said values soluble in said leach solution to said tank at the feed end thereof, intermittently fluidizing the particulate ore by adding leach solution uniformly across and along the length of the tank for five to ten seconds and withdrawing said leach solution for about 10 to 20 seconds whereby a jigging action is created to move said ore particles up and down for classifying said particles into strate according to size, shape and density, and for moving the classified particles from the feed end to the discharge end of the tank, whereby said particles are stratified while soluble metal values for concurrently dissolved by the leach solution, withdrawing classified particles from said tank, treating the leach solution for recovery of the said values therefrom, and recycling said leach solution for intermittently fluidizing the particle ore.

3. A method as claimed in claim 2 wherein a bed of crushed stone is formed at the bottom of the tank and said leach solution is withdrawn through said bed of crushed stone for filtering of the leach solution.

* * * * *